US011142991B2

(12) United States Patent
Wilcox et al.

(10) Patent No.: US 11,142,991 B2
(45) Date of Patent: Oct. 12, 2021

(54) PLUG INSERT FOR A FRAC PLUG TOOL AND METHOD OF ASSEMBLING THEREOF

(71) Applicant: Halliburton Energy Services, Inc., Houston, TX (US)

(72) Inventors: David J. Wilcox, Thornton, CO (US); Kevin B. Chaffer, Denver, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 12 days.

(21) Appl. No.: 16/603,992

(22) PCT Filed: Jun. 29, 2017

(86) PCT No.: PCT/US2017/040077

§ 371 (c)(1),
(2) Date: Oct. 9, 2019

(87) PCT Pub. No.: WO2019/005077

PCT Pub. Date: Jan. 3, 2019

(65) Prior Publication Data

US 2020/0115988 A1 Apr. 16, 2020

(51) Int. Cl.

| | |
|---|---|
| ***E21B 33/134*** | (2006.01) |
| ***E21B 33/12*** | (2006.01) |
| ***E21B 43/26*** | (2006.01) |

(52) U.S. Cl.

CPC ..... *E21B 33/134* (2013.01); *E21B 33/12* (2013.01); *E21B 43/26* (2013.01)

(58) Field of Classification Search

CPC ..... E21B 33/134

See application file for complete search history.

(56) References Cited

U.S. PATENT DOCUMENTS

| | | | | |
|---|---|---|---|---|
| 3,228,473 | A * | 1/1966 | Baker | E21B 34/14 166/154 |
| 7,740,079 | B2 | 6/2010 | Clayton et al. | |
| 8,127,856 | B1 | 3/2012 | Nish et al. | |
| 8,267,177 | B1 | 9/2012 | Vogel et al. | |
| 2010/0219592 | A1* | 9/2010 | Tuckness | E21B 33/10 277/638 |
| 2012/0006532 | A1 | 1/2012 | Frazier | |
| 2013/0327517 | A1 | 12/2013 | Good, III et al. | |
| 2016/0298403 | A1* | 10/2016 | Davis | E21B 33/129 |
| 2017/0130553 | A1 | 5/2017 | Harris et al. | |
| 2018/0045014 | A1* | 2/2018 | Larisey | E21B 33/12 |

FOREIGN PATENT DOCUMENTS

| | | | |
|---|---|---|---|
| WO | 2014210390 | A2 | 12/2014 |
| WO | 2019005077 | A1 | 1/2019 |

* cited by examiner

*Primary Examiner* — D. Andrews

(74) *Attorney, Agent, or Firm* — Scott Richardson Parker Justiss, P.C.

(57) ABSTRACT

A plug insert for use in a frac plug tool comprising a plug top, a plug body and an elastomeric O-ring, The plug top is shaped to rest on a seat of an upper end of a mandrel of the frac plug tool and the plug body is shaped to fit in a flow passage of the mandrel wherein the plug body includes a shear pin opening. The elastomeric O-ring is locatable around a portion of the plug body and sized to block fluid flow through the flow passage of the mandrel when the plug body is located in the flow passage. A frac plug tool for use in a well comprising the plug insert and a shear pin to hold that insert above the mandrel seat of the tool and method of assembling the tool are also disclosed.

20 Claims, 6 Drawing Sheets

PLUG INSERT FOR A FRAC PLUG TOOL AND METHOD OF ASSEMBLING THEREOF

CROSS-REFERENCE TO RELATED APPLICATION

This application is the National Stage of, and therefore claims the benefit of, International Application No. PCT/US2017/040077 filed on Jun. 29, 2017, entitled "PLUG INSERT FOR A FRAC FLUG TOOL AND METHOD OF ASSEMBLING THEREOF," which was published in English under International Publication Number WO 2019/005077 on Jan. 3, 2019. The above application is commonly assigned with this National Stage application and is incorporated herein by reference in its entirety.

BACKGROUND

Frac plug tools, such as swellable or mechanical packer assemblies, are often used as isolation barriers in hydraulic fracturing operations to isolate different fracture stages at discrete formation intervals across different portions (e.g., vertical, diagonal or lateral portions) of the wellbore. To position a frac plug tool, fluid can be pumped to move the tool, connected to a wireline, to the target location in the wellbore. Typically, after the frac plug tool's position is set, the wireline is withdrawn and then additional fluid is pumped to transport a ball-shaped plug ("frac plug ball") down the wellbore to mate with the frac plug tool. The additional fluid to transport the frac plug ball can amount to a considerable additional expenditure of fluid and time thereby increasing the costs to complete the well. Alternatively, a frac tool with the frac plug ball (e.g., a caged ball) already in place in the tool may be used. However, if the tool is mistakenly placed in the wrong location in the wellbore, then the tool will have to be milled out of the wellbore, again increasing the cost to complete the hydraulic fracturing operation.

BRIEF DESCRIPTION

Figure 1:
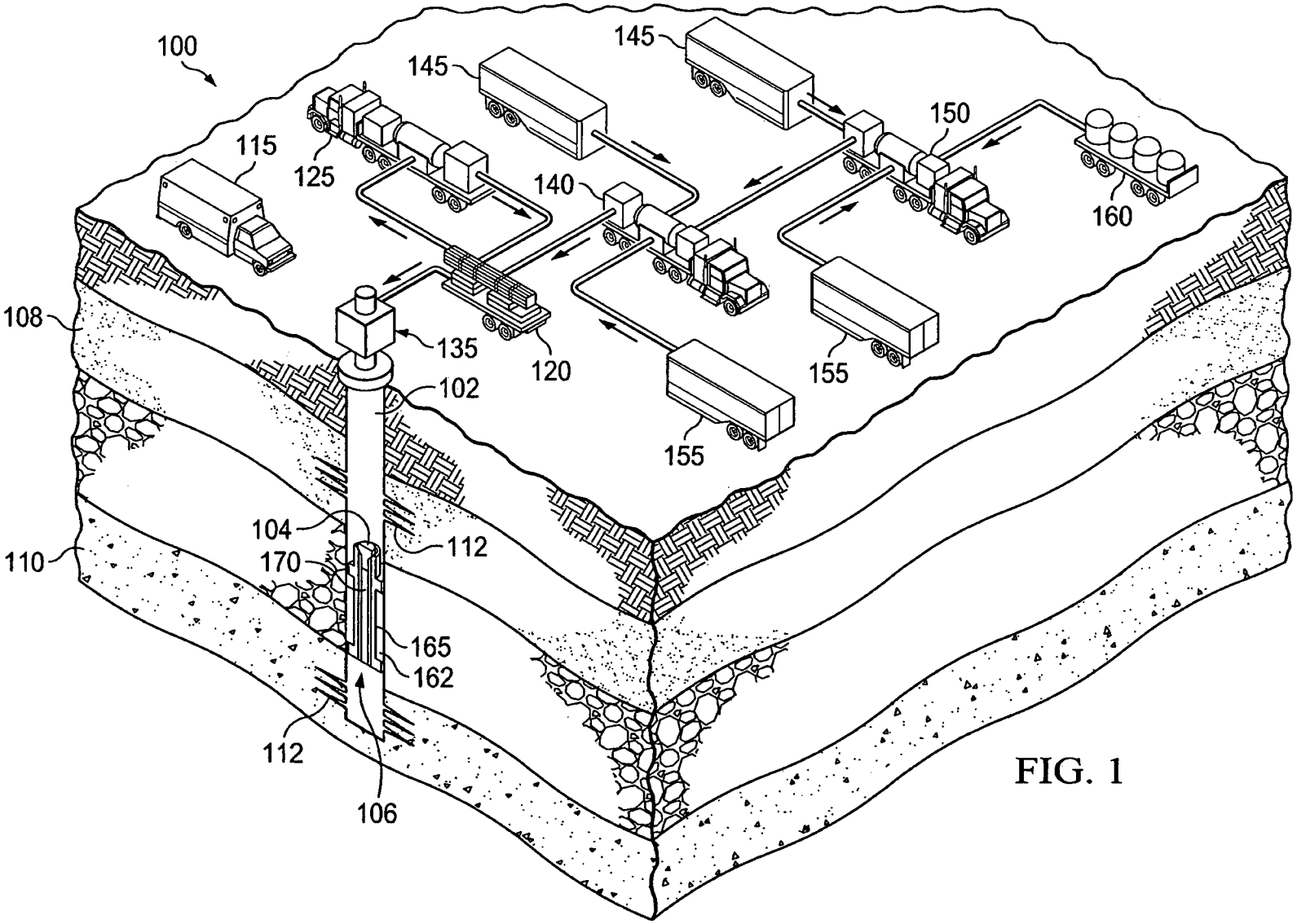
Figure 2:
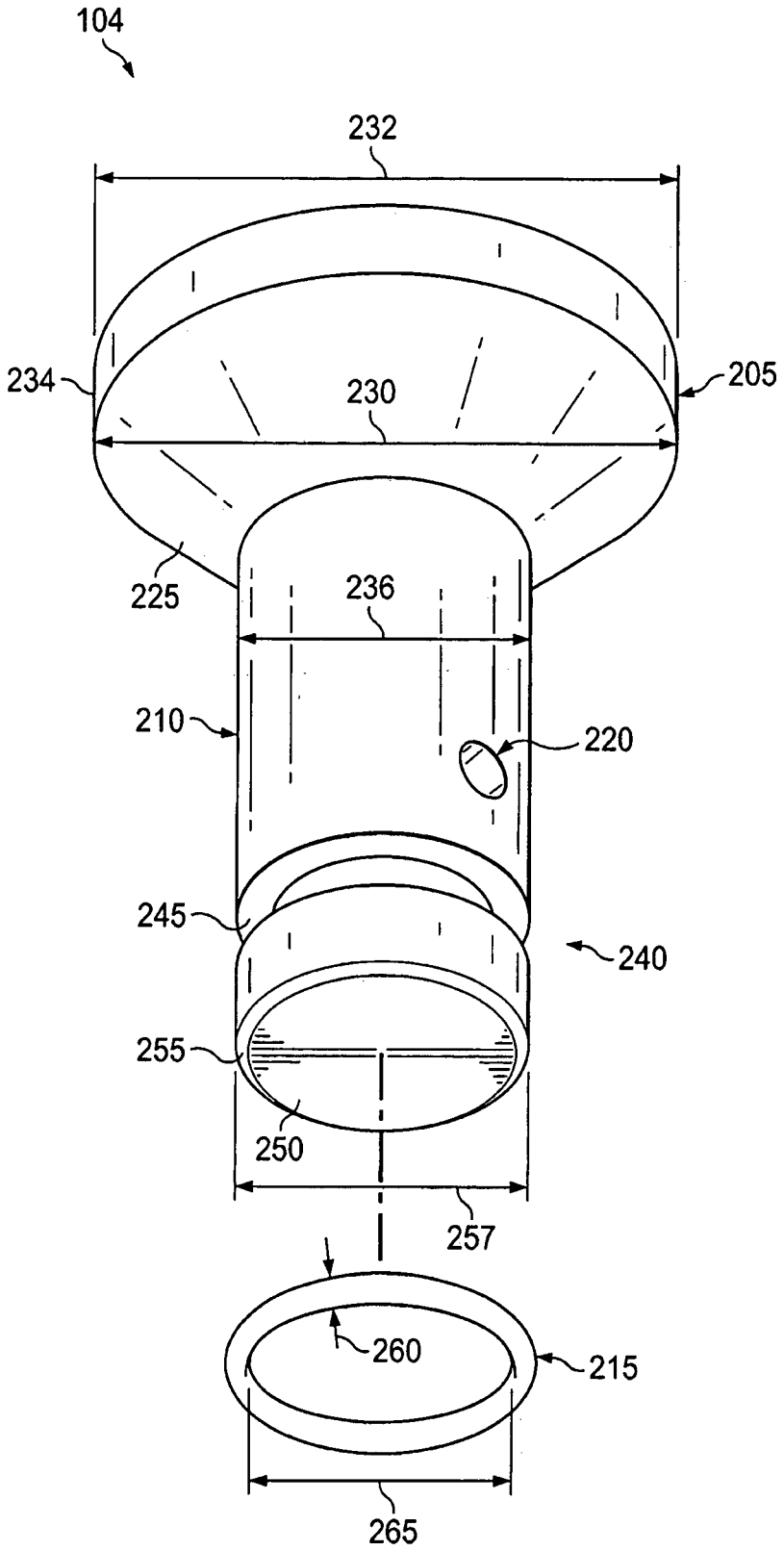

Reference is now made to the following descriptions taken in conjunction with the accompanying drawings, in which:

FIG. 1 illustrates a general view of an example hydraulic fracturing system associated with a wellbore in which a plug insert and a frac plug tool of the disclosure can be used;

FIG. 2 presents an exploded perspective view of an example embodiment of a plug insert of the disclosure; and FIGS. 3A-3D present sectional perspective views of the example plug insert and an upper segment of a frac plug tool embodiment of the disclosure at different stages of assembly.

DETAILED DESCRIPTION

As illustrated in the example embodiments presented below, the plug insert of the present invention, when connected to a frac plug tool, can eliminate the need to expend additional time and fluid to place a frac plug ball after placing a frac plug tool in a wellbore. Additionally, in the event the frac plug tools is mistakenly placed, the plug insert can be readily removed from the frac plug tool allowing for the plug tool to be removed via a scour fracturing operation, or, the frac plug tool with the plug insert in place can be relocated to the correct location in the wellbore.

In the drawings and descriptions that follow, like parts are typically marked throughout the specification and drawings with the same reference numerals, respectively. The drawn figures are not necessarily to scale. Certain features of this disclosure may be shown exaggerated in scale or in somewhat schematic form and some details of conventional elements may not be shown in the interest of clarity and conciseness. Specific embodiments are described in detail and are shown in the drawings, with the understanding that they serve as examples and that they do not limit the disclosure to only the illustrated embodiments. Moreover, it is fully recognized that the different teachings of the embodiments discussed, infra, may be employed separately or in any suitable combination to produce desired results.

Unless otherwise specified, any use of any form of the terms such as "press," "connect," "engage," "couple," "attach," or any other term describing an interaction between elements is not meant to limit the interaction to direct interaction between the elements but include indirect interaction between the elements described, as well. In the following discussion and in the claims, the terms "including" and "comprising" are used in an open-ended fashion, and thus should be interpreted to mean "including, but not limited to." Further, any references to "first," "second," etc. do not specify a preferred order of method or importance, unless otherwise specifically stated but are intended to designate separate elements. The various characteristics mentioned above, as well as other features and characteristics described in more detail below, will be readily apparent to those skilled in the art with the aid of this disclosure upon reading the following detailed description of the embodiments, and by referring to the accompanying drawings.

FIG. 1 illustrates a general view of an example hydraulic fracturing system 100 associated with a wellbore 102 in which the plug insert 104 and frac plug tool 106 of the disclosure can be used. Once discrete formation intervals 108, 110 for different fracture stages are identified or reached, the frac plug tool 106, with the plug insert 104 in place in the tool, can be positioned in the wellbore 102 to isolate the intervals 108, 110 from each other and a conventional hydraulic fracturing operation may be used to create fractures 112 in the intervals 108, 110 to increase formation porosity for the purpose of increasing oil or gas production. The fracturing system 100 can include, among other things, an operation control unit 115, a manifold unit 120, a frack pump 125, and a wellhead tree 135 to cap the wellbore 102. The fracturing system 100 can also include a slurry blender system 140 where a hydrated gel is combined with the other fracturing additives and proppant (e.g., sand). The slurry blender system 140 can include one or more of the following: fluid tanks 145, a gel blender 150, and other fracking component storage tanks 155, such as chemical and sand storage tanks. A gel hydration apparatus 160 can be coupled to the slurry blender system 140. One skilled in the pertinent art would understand how fracturing fluid, pumped into the wellbore 102 at a high rate to increase the pressure in the wellbore 102, could be used as part of the system 100 to create or increase fractures 112 in the formation intervals 108, 110. For instance, the fracturing fluid can includes a hydrated gel, can be pumped along with the proppant into the fractures 112 to prop the fractures in the formation open, thereby, effectively increasing the formation's porosity.

One skilled in the pertinent arts would understand how the frac plug tool 106 could be located in the wellbore 102, e.g., between an already fractured lower interval 110 and an upper interval 108 to be fractured, to serve as a fluid isolation barrier between the intervals 108 110. For instance, once the tool 106 is positioned at a target location in the wellbore 102, a conventional swellable or mechanical packer element 162, wrapped around a mandrel 165 of the tool 106, can be radially expanded in the wellbore 102 to seal off fluid flow between the intervals 108, 110.

FIG. 2 presents an exploded perspective view of an embodiment of a plug insert 104 of the disclosure. FIGS. 3A-3D present sectional perspective views of the example plug insert 104 and an upper segment of an embodiment of a frac plug tool 106 of the disclosure at different stages of assembly.

One embodiment of the disclosure is a plug insert for use in a frac plug tool (e.g., plug insert 104 for tool 106, FIG. 1). As illustrated in FIG. 2 embodiments of the plug insert 104 can comprise a plug top 205, a plug body 210 and an elastomeric O-ring 215. The plug top 205 is shaped to rest on a seat of an upper end of the mandrel (e.g., seat 310 of mandrel 165, FIG. 3A). The plug body 210 is shaped to fit in a flow passage of the mandrel (e.g., flow passage 170 in the mandrel 165 of the tool 106, FIG. 1). The plug body 210 includes a shear pin opening 220. The elastomeric O-ring 215 is locatable (e.g., located) around a portion of the plug body 210 and the elastomeric O-ring is sized to block fluid flow through the flow passage of the mandrel when the plug body 210 is located in the flow passage.

Figure 3A:
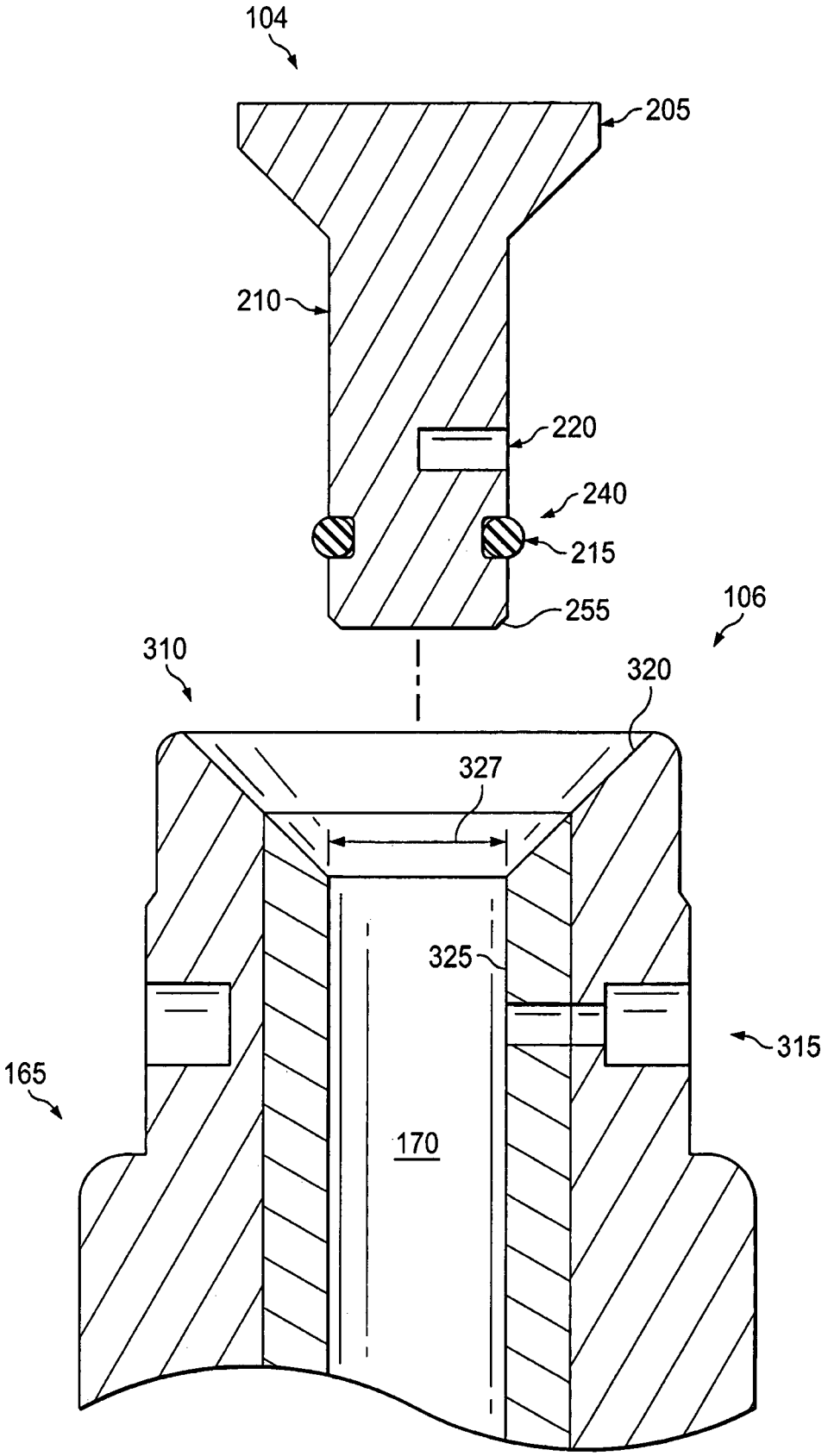

As further illustrated in FIG. 2, for any embodiments of the plug insert 104, the plug top 205 can include a conically-shaped portion 225 sized to mate with a slanted sidewall of the seat of the mandrel (e.g. slanted seating sidewall 320, FIG. 3A). For instance, a diameter 230 of the conically-shaped portion 225 can be constructed so as to gradually change from being equal to a diameter 232 of a top portion 234 of the plug top 205 to being equal to a diameter 236 of the plug body 210. The conically shaped portion 225 facilitates the plug insert 104 to be less susceptible to stresses from fluid pressure in the wellbore that could distort the plug insert 104. In other embodiments, however, the plug top 205 could have other shapes e.g., to match the shape of the seat of mandrel. For example, the plug top 205 could be cylindrically-shaped with a diameter 232 larger than the diameter 236 of the cylindrical shaped plug body 210 such that the plug insert 104 has a T-shaped profile, e.g., e.g. to mate with an inversely shaped mandrel seat 310.

As illustrated in FIG. 2, for any embodiments of the plug insert 104, the portion of the plug body 240 that the elastomeric O-ring 215 is located around can further include an annular groove 245 around the plug body 210, such that the annular groove 245 seats a portion of the elastomeric O-ring 215 therein. For instance, the annular grove 245 can partially contain the O-ring therein. For instance, in some embodiments, the annular groove 245 can be sized to accommodate from about 85 to 99 percent of the volume of the O-ring 215 therein.

As illustrated in FIG. 2, for any embodiments of the plug insert 104, an end 250 of the plug body 210, located opposite to the plug top 205, can include a chamfered or filleted edge 255. For instance, the plug body 210 can be sloped such that the end 250 of the body 210 has a diameter 257 that is about 10 percent smaller than the diameter 235 of the bulk of cylindrically shape plug body 210. The chamfered or filleted edge 255 can facilitate slipping the O-ring 215 around the plug body 210 and facilitate placing the plug insert 104 into the flow passage 170 of the mandrel 165.

The material of construction of the plug insert 104 and size of the plug body 210, annular groove 245 and elastomeric O-ring 215 can be selected to provide a suitable contact seal between the plug body 210 and the interior sidewalls defining the flow passage in the mandrel (e.g., interior sidewalls 325, FIG. 3A). The contact seal between the O-ring 215 and the interior sidewalls 325 can be such that fluid transfer is prevented between formation intervals 108, 110 of isolated by the frac plug tool 106 at hydraulic fracturing pressure differentials present between the intervals 108, 110 when hydraulic fracturing operations are conducted above the frac plug tool 106. The contact seal between the O-ring 215 and the interior sidewalls can also be such that, after the fracturing operations are completed, still higher fluid differentials can be used to push the plug top 205 down through the passage of the mandrel 165 (e.g., into the lower interval 110) to allow the flow of fluid from the lower interval 110 through passageway of the mandrel to the wellbore surface.

For example, for any embodiments of the plug insert 104, the elastomeric O-ring 215 can be composed of rubber polymer materials such as fluoroelastomer, perfluoroelastomer or nitrile rubber polymers. Non-limiting examples include the fluoroelastomer polymer Viton® (The Chemours Co., Wilmington, Del.), fluoroelastomers based upon an alternating copolymer of tetrafluoroethylene and propylene such as AFLAS® (Asahi Glass Co., Ltd., Japan), perfluoroelastomer such as the polytetrafluoroethylene Chemraz® (Greene, Tweed & Co., Houston, Tex.) or nitrile rubber polymers such as acrylonitrile butadiene terpolymer.

For example, for any embodiments of the plug insert 104, embodiments the plug body 210 diameter 236 can be in a range from about 90 to 99 percent of a diameter of the mandrel passageway (e.g., diameter 327, FIG. 3A), and the elastomeric O-ring 215 can have a cross-sectional width 260 in a range from about 1 to about 5 mm, and in some embodiments, in a range from about 3 to 4 mm and an inside diameter 265 in a range from about 10 to about 20 mm.

As a non-limiting example, consider a scenario where the flow passage 170 in the mandrel has a diameter 327 of about 10 to about 20 mm and a maximum pressure differential (e.g., a wellbore pressure above the frac plug tool minus the wellbore pressure below tool) between the formation intervals 108, 110 during hydraulic fracturing operations equals about 13.8 MPa (2000 psi). Additionally, at a differential pressure of greater than 13.8 MPa the plug insert 104 can pass down through the flow passage 170 of the mandrel 165. For such a scenario, an embodiment of the plug inert 104 can have a plug body diameter 236 in a range from about 10 to about 20 mm (e.g., a few percent less than the diameter 327 of the flow passage 170 of the mandrel 165) and the elastomeric O-ring 215, prior to placement around the plug inert 104, can have a cross-sectional width 260 in a range from about 1 to about 5 mm.

For any embodiments of the plug insert 104, the plug insert 104 can be composed of a material predisposed to dissolution by a chemical dissolution solvent that is different in composition than the composition of the wellbore fluid used in hydraulic fracturing operations. Providing such a dissolvable plug insert can facilitate milling out the frac plug tool 106, e.g., once the hydraulic fracturing operation is completed as there is less material to mill out, or, when the wellbore is screened out to remove excess proppant from the wellbore. For example, when the plug insert 104 is composed of a magnesium containing metal alloy, the dissolution solvent can include acids such as hydrochloric acid, nitric acids, sulfuric acid or salts such about 10 wt % sodium chloride or about 3 wt % potassium chloride or combinations thereof. For example, when the plug insert 104 is composed of polymeric compositions such as hardened epoxy resins, thermoplastics, or elastomers, the dissolution solvent can include tetrahydrofuran (THF), methyl acetate (MA), isopropanol and methanol or combinations thereof.

Figure 3B:
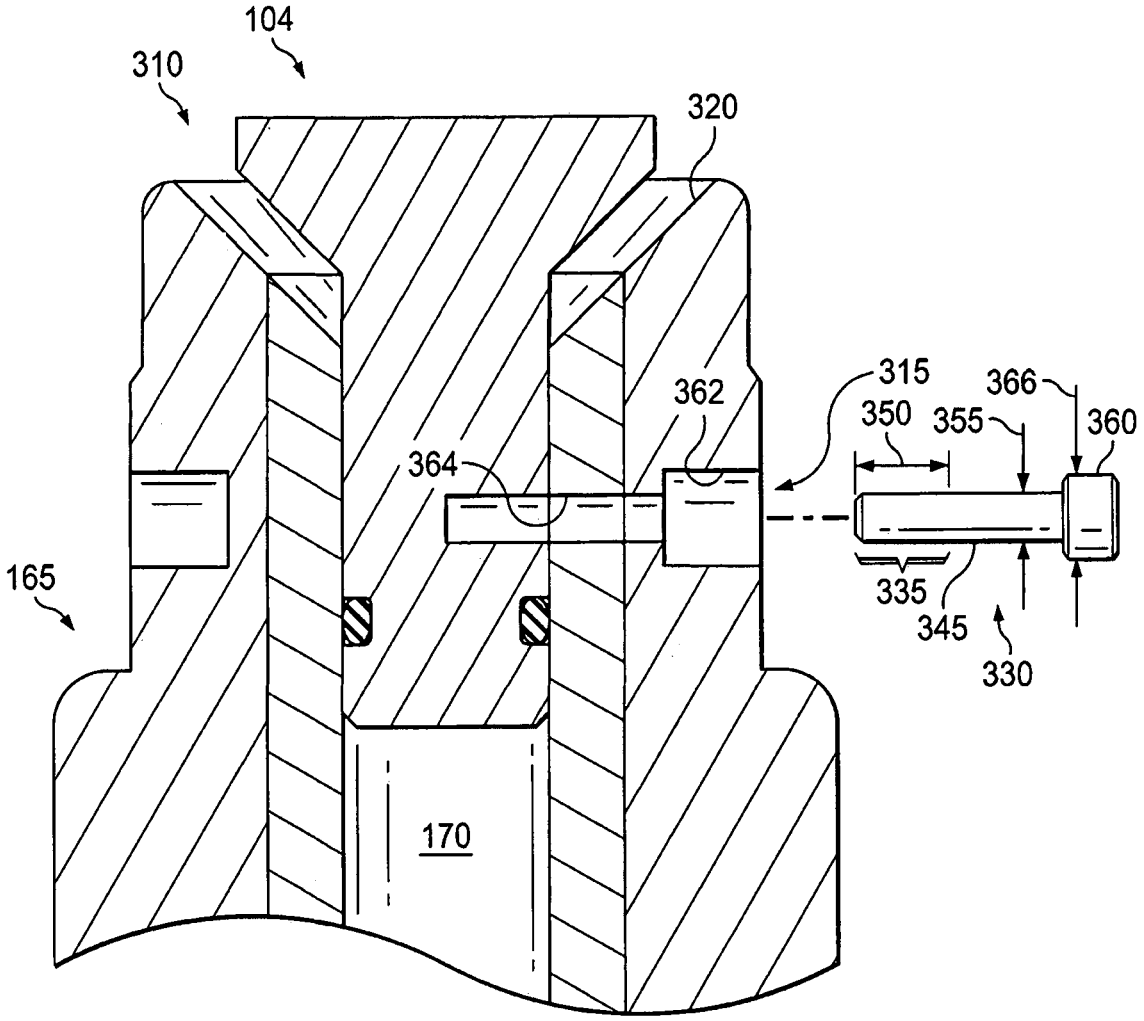

Another embodiment of the disclosure is a frac plug tool for use in a well. As illustrated in FIGS. 3A-3B, embodiments of the frac plug tool 106 can comprise a mandrel 165, a plug insert 104 and a shear pin 330. The mandrel 165 has a flow passage 170 there-through and an upper end of the mandrel 165 has a seat 310. The frac plug tool 106 can include any of the embodiments of the plug insert 104 such as described above in the context of FIG. 2. For instance, the plug insert 104 can include the plug top 205 (e.g., including a conically shaped portion 225) shaped to rest on the seat 310, the plug body 210 can be shaped to fit inside of the flow passage 170 and include a shear pin opening 220 sized to accommodate an end portion of a shear pin therein (e.g., shear pin 330, FIG. 3B). The elastomeric O-ring 215 can be sized to block fluid flow through the flow passage 170. Embodiments of the plug body 210 can include the annular groove 245 to seat a portion of the elastomeric O-ring 215 therein and include the chamfered or filleted edge 255.

Figure 3C:
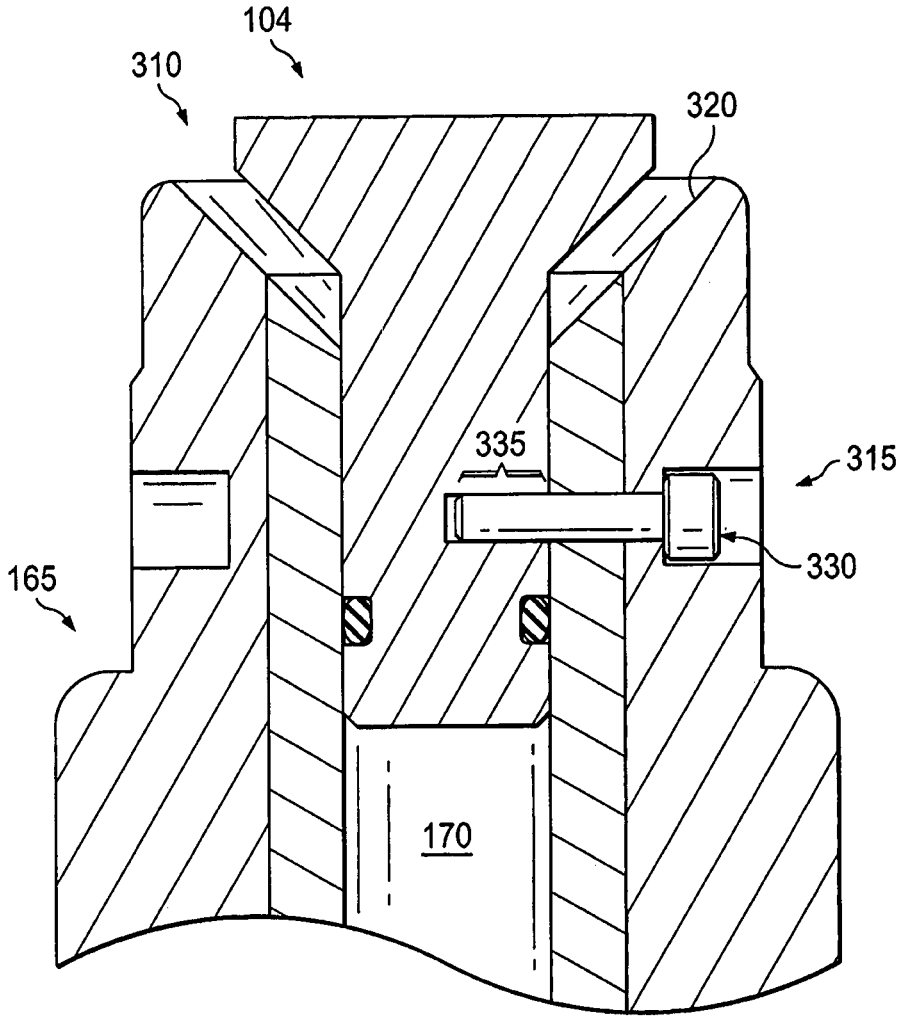

As illustrated in FIGS. 3B-3C, an end portion 335 of the shear pin 330 is configured to pass through a sidewall opening 315 in an upper end of the mandrel 165 and into the shear pin opening 220 such that the plug top 205 is held above the seat 310 of the mandrel 165 when the plug body 210 is located in the flow passage 170. As further illustrated, embodiments of the mandrel seat 310 can have slanted sidewalls 320. The sidewalls 320 can be shaped to conformably seat a conically shaped portion (e.g. portion 225, FIGS. 2-3A) of the plug top 205 thereon, or, the portion 225 of the plug top 205 can be shaped to conformally sit on the slanted sidewalls 320.

Figure 3D:
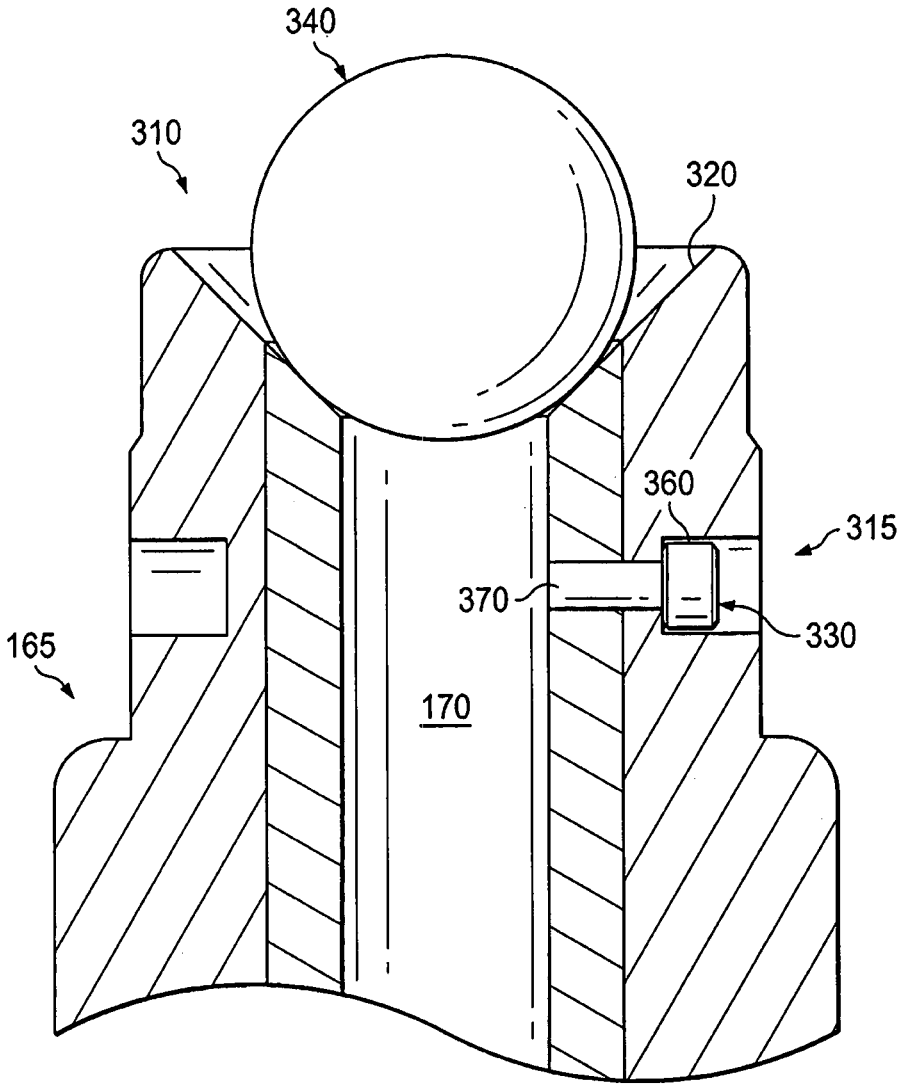

As further illustrated in FIG. 3D, the sidewalls 320 can be shaped to seat a frac plug ball 340 thereon. Having slanted sidewalls 320 that can both seat the plug insert 104 and the frac plug ball 340 allows the option of the frac plug tool 106 to be used with a conventional frac plug ball. For instance, once an operator has determined that the tool has been placed in the proper location in the wellbore 102 the plug insert 104 can be removed, e.g., by pushing the plug insert through flow passage 170 to the wellbore below the tool's location, by dissolving the plug insert or dislodging the insert above the tool 106, and, then a frac plug ball 340 can be transported on to the sidewalls 320.

Embodiments of the shear pin 330 can be configured to retain the plug insert 104 such that the plug top 205 is held above the seat 310 of the mandrel 165 for situations where the frac plug tool 106 has been inadvertently placed in the wrong location in the wellbore 102 and therefore the frac plug tool 106 needs to be relocated in the wellbore 102, e.g., using a conventional wireline tool. For such situations, the fluid flow through the wellbore can reverse such that a negative pressure differential exists, where the fluid pressure in the wellbore 102 below the tool 106 (e.g., in interval 110) is higher than the fluid pressure in the wellbore 102 above the tool 106 (e.g., in interval 108). Such negative pressure differentials (e.g., up to about 10 to 17 MPa in some embodiments), in the absence of the shear pin 330, can cause the plug insert 104 to pop out of the flow passage 170 and thus become permanently separated from the rest of the tool 106 whereupon the tool 106 is unable to re-establish fluid isolation between the intervals 108, 110 at the tool's relocated position in the wellbore 102.

Embodiments of the shear pin 330 can be configured to be sheared at differential pressures present during hydraulic fracturing operations. For instance, in some hydraulic fracturing operations, a positive pressure differential can exist where the fluid pressure in the wellbore 102 above the tool 106, where the operation is conducted (e.g., in interval 108), is higher than the fluid pressure in the wellbore 102 below the tool 106 (e.g., in interval 108). At such positive pressure differentials (e.g., from about 10 to 17 MPa in some embodiments) the shear pin 330 can shear while the plug insert 104 with the sheared-off end portion 335 of the shear pin 330 is retained in the flow passage 170 to maintain isolation between the intervals 108, 110 above and below the tool 106.

At pressure differentials still higher than such hydraulic fracturing pressure differentials (e.g., greater that about 10 to 17 MPa in some embodiments), the plug insert can be configured to pass down through the flow passage 170 of the mandrel 165.

In some embodiments of the shear pin 330, to facilitate pin retention and shearing at target pressure differential values in the wellbore, a pin body 345 of the shear pin 330 can be configured to extend into the opening 220 of the plug body 210 by a length 350 that is equal to or greater than a diameter 355 of the pin body 345, and some embodiments a length 350 that is about 2 to 3 times a diameter 355 of the pin body 345.

In some embodiments, to facilitate placing the shear pin body 345 at a predefined length 350 into the opening 220, the shear pin 330 can include a pin head 360 configured to pass into a mounting portion 362 of the sidewall opening 345 of the mandrel 165 and stop at a through-hole portion 364 of the sidewall opening 345 in the mandrel where the pin body 345 of the shear pin 330 passes through the through-hole portion 364. For instance, embodiment of the pin head 360 can have a diameter 366 that is about 2 to 3 times larger than the diameter 355 of the pin body 345.

In some embodiments, to facilitate reversible or adjustable lengths of insertion into the plug insert opening 220, the pin head 360 can be threaded to a threaded mounting portion 362 of the sidewall opening 345. In other embodiments, the shear pin 330 can be configured as a press-fit fastening such as a spring grooved, knurled dowel, or barbed pins (e.g., Driv-Lok Inc., Sycamore, Ill.). Such press-fit shear pins 330 can be hammered into the sidewall opening 345 to facilitate rapid placement of the pin 330 in the openings 220, 345.

In some such embodiments the pin head can be configured to be retained (e.g., locked or fixed) in the mounting portion 362 of the sidewall opening 345 after the shear pin 330 has been sheared apart, e.g., so as to block fluid flow through the sidewall opening 345 after the plug insert 104 has been removed from the tool 106 and a frac plug ball 340 has been placed on the mandrel seat 310 to isolated fluid flow between the intervals 108, 110 above and below the tool 106 for subsequent hydraulic fracturing operations.

In some embodiments, the shear pin 330 can be composed of brass. Brass pins 330 are selected to have shearability at the differential pressure environments encountered by the tool 106 during hydraulic fracturing operations. For instance, in some embodiments of the shear pin 330, the pin body diameter 355 is a value in a range from about 0.3 cm to 1 cm.

In other embodiments, the shear pin 330 can be composed of aluminum, steel or other metals or metal alloys. Based on the present disclosure, one skilled in the pertinent arts would understand how to adjust the size of such shear pins to provide the desired shearability at the pressure differentials present for the wellbore being completed.

Another embodiment of the disclosure is a method of assembling a frac plug tool for use in a wellbore, such as any of the embodiments of the frac plug tool 106 disclosed in the context of FIGS. 1-3D.

As illustrated in FIG. 3A, the method can comprise providing a mandrel 165 having a flow passage 170 there-through, an upper end of the mandrel having a seat 310, and, providing a plug insert 104 having a plug top 205, plug body 210 and elastomeric O-ring 215.

As illustrated in FIG. 3B, the method can comprise connecting the plug insert 104 to the upper end of the mandrel 165, where: the plug body 210 is located inside of the flow passage 170, the plug top 205 is shaped to rest on the seat 310 and the elastomeric O-ring 215 is located around a portion 240 of the plug body 210 and configured to block fluid flow through the flow passage 170 of the mandrel 165.

As illustrated in FIG. 3C, the method can comprise inserting an end portion 335 of a shear pin 330 through a sidewall opening 315 in the upper end of the mandrel 165 and into an opening 220 of the plug body 210, such that the plug top 205 is held above the seat 310.

Some embodiments of the method include shearing the shear pin 330 apart by applying a pressure differential (e.g., a hydraulic fracturing pressure differential value in a range from about 10 Mpa to 17 MPa, in some embodiments) between a formation interval located below the frac plug tool in the wellbore and a formation interval located above the frac plug tool during a hydraulic fracturing operation in the formation interval located above the frac plug tool, where the plug body remains in the flow passage 170.

As illustrated in FIG. 3D, in some embodiments of the method, after shearing the shear pin 330 remnants of the shear pin (e.g., portions of the pin body 370 not including the sheared-off end portion 335 and the pin head 360) can remain in the sidewall opening 315 to block fluid flow there-through.

Some embodiments of the method include removing the plug insert 104 from the frac plug tool 106 by applying a pressure differential to push the plug insert 104 down through the flow passage 170 of the mandrel 165, the pressure differential being above a hydraulic fracturing pressure differential (e.g., pressure differentials above about 10 Mpa to 17 MPa, in some embodiments) between formation intervals 108, 110 of the wellbore located above and below the frac plug tool 106.

As illustrated in FIG. 3D, some embodiments of the method include placing a frac plug ball 340 on the seat 310 of the mandrel 165 after removing the plug insert 104 from the frac plug tool 106. One skilled in the pertinent art would be familiar with methods, e.g., using fluid pressure or wireline tools to lower the frac plug ball 340 onto the seat 310 (e.g., to rest on the slanted sidewalls 320).

Those skilled in the art to which this application relates will appreciate that other and further additions, deletions, substitutions and modifications may be made to the described embodiments.

What is claimed is:

1. A plug insert for use in a frac plug tool, comprising:

a plug top shaped to rest on a seat of an upper end of a mandrel of the frac plug tool;

a plug body shaped to fit in a flow passage of the mandrel wherein the plug body includes a shear pin opening; and an elastomeric O-ring locatable around a portion of the plug body, the elastomeric O-ring sized to block fluid flow through the flow passage of the mandrel when the plug body is located in the flow passage, wherein the plug insert is configured to pass down through the flow passage of the mandrel when located in a wellbore at a pressure differential above a hydraulic fracturing pressure differential between formation intervals of the wellbore located above and below the frac plug tool.

2. The plug insert, of claim 1, wherein the plug top includes a conically shaped end sized to mate with slanted sidewalls of the seat of the mandrel.

3. The plug insert of claim 1, wherein the portion of the plug body includes an annular groove around the plug body such that the annular groove seats a portion of the elastomeric O-ring therein.

4. The plug insert of claim 1, wherein an end of the plug body opposite the plug top includes a chamfered or filleted edge.

5. The plug insert of claim 1, wherein the elastomeric O-ring is composed of a fluoroelastomer, a perfluoroelastomer or a nitrile rubber polymer.

6. A frac plug tool for use in a well, comprising:

a mandrel having a flow passage there through, an upper end of the mandrel having a seat;

a plug insert having a plug body, a plug top, and an elastomeric O-ring, wherein:

the plug top is shaped to rest on the seat;

the plug body is shaped to fit inside of the flow passage of the mandrel, wherein the plug body includes a shear pin opening, and the elastomeric O-ring is locatable around a portion of the plug body, the elastomeric O-ring sized to block fluid flow through the flow passage of the mandrel when the plug body is located in the flow passage; and a shear pin, an end portion of the shear pin configured to pass through a sidewall opening in an upper end of the mandrel and into an opening of the plug body such that the plug top is held above the seat when the plug body is located in the flow passage.

7. The frac plug tool of claim 6, wherein the seat of the mandrel has slanted sidewalls.

8. The frac plug tool of claim 7, wherein the slanted sidewalls are shaped to conformally seat a conically shaped portion of the plug top thereon.

9. The frac plug tool of claim 7, wherein the slanted sidewalls are configured to seat a frac plug ball thereon.

10. The frac plug tool of claim 6, wherein the shear pin is configured to shear at a pressure differential between formation intervals of the wellbore above and below the frac plug tool at a value in a range from 10 MPa to 17 MPa.

11. The frac plug tool of claim 6, wherein a pin body of the shear pin extends into the opening of the plug body by a length that is equal to or greater than a diameter of the pin body.

12. The frac plug tool of claim 11, wherein the shear pin has a pin body diameter that is a value in a range from 0.3 cm to 1 cm.

13. The frac plug tool of claim 6, wherein the shear pin includes a pin head configured to pass into a mounting portion of the sidewall opening of the mandrel and stop at a through-hole portion of the sidewall opening, wherein a pin body of the shear pin passes through the through-hole portion.

14. The frac plug tool of claim 13, wherein the pin head is configured to be retained in the mounting portion of the sidewall opening after the shear pin has been sheared apart.

15. The frac plug tool of claim 6, wherein the shear pin is composed of brass.

16. A method of assembling a frac plug tool for use in a wellbore, comprising:

providing a mandrel having a flow passage there-through, an upper end of the mandrel having a seat;

providing a plug insert having a plug top, plug body and elastomeric O-ring;

connecting the plug insert to the upper end of the mandrel, wherein the plug body is located inside of the flow passage, the plug top is shaped to rest on the seat and the elastomeric O-ring, located around a portion of the plug body, is configured block fluid flow through the flow passage of the mandrel; and inserting an end portion of a shear pin through a sidewall opening in the upper end of the mandrel and into an opening of the plug body, such that the plug top is held above the seat.

17. The method of claim 16, further including shearing the shear pin apart by applying a pressure differential between a formation interval located below the frac plug tool in the wellbore and a formation interval located above the frac plug tool during a hydraulic fracturing operation in the formation interval located above the frac plug tool.

18. The method of claim 16, further including removing the plug insert from the frac plug tool by applying a pressure differential to push the plug insert down through the flow passage of the mandrel, the pressure differential being above a hydraulic fracturing pressure differential between formation intervals of the wellbore located above and below the frac plug tool.

19. The method of claim 18, further including placing a frac plug ball on the seat of the mandrel after removing the plug insert from the frac plug tool.

20. A plug insert for use in a frac plug tool, comprising:

a plug top shaped to rest on a seat of an upper end of a mandrel of the frac plug tool;

a plug body shaped to fit in a flow passage of the mandrel wherein the plug body includes a shear pin opening;

an elastomeric O-ring locatable around a portion of the plug body, the elastomeric O-ring sized to block fluid flow through the flow passage of the mandrel when the plug body is located in the flow passage; and a shear pin, an end portion of the shear pin configured to pass through a sidewall opening in an upper end of the mandrel and into an opening of the plug body such that the plug top is held above the seat when the plug body is located in the flow passage.

* * * * *